United States Patent [19]

Shklovsky

[11] 4,384,799

[45] May 24, 1983

[54] COMBINATION WRITING INSTRUMENT AND LIGHTER

[76] Inventor: Alexander Shklovsky, 1919 Faith Pl., Apt. F, Gretna, La. 70053

[21] Appl. No.: 265,436

[22] Filed: May 20, 1981

[51] Int. Cl.[3] ..... B43K 29/16

[52] U.S. Cl. ..... 401/195

[58] Field of Search ..... 401/195

[56] References Cited

U.S. PATENT DOCUMENTS

| | | | |
|---|---|---|---|
| 1,574,800 | 3/1926 | Duncan | 401/195 |
| 1,779,110 | 10/1930 | Zapanta | 401/195 |
| 2,236,683 | 4/1941 | Gudge | 401/195 |
| 2,269,591 | 1/1942 | Locker | 401/52 |
| 2,308,225 | 1/1943 | Edenberg | 401/195 |
| 2,573,760 | 11/1951 | Cherne | 401/52 |
| 3,282,253 | 11/1966 | Ryan et al. | 401/195 |
| 3,429,644 | 2/1969 | Mueller | 401/195 |
| 3,438,716 | 4/1969 | Peters | 401/195 |
| 3,615,596 | 10/1972 | Pelti et al. | 401/52 |
| 4,244,525 | 1/1981 | Manna | 401/195 |

FOREIGN PATENT DOCUMENTS

| | | | |
|---|---|---|---|
| 806411 | 7/1951 | Fed. Rep. of Germany | 401/52 |
| 1962749 | 6/1971 | Fed. Rep. of Germany | 401/195 |
| 1430124 | 1/1966 | France | 401/195 |
| 697887 | 11/1965 | Italy | 401/195 |
| 430370 | 6/1935 | United Kingdom | 401/195 |
| 807295 | 1/1959 | United Kingdom | 401/195 |

*Primary Examiner*—William Pieprz

*Attorney, Agent, or Firm*—Shlesinger, Arkwright, Garvey & Dinsmore

[57] ABSTRACT

A combination writing instrument and lighter including a barrel housing having a longitudinal axis and ends, a writing unit mounted in one end of the housing, a lighter unit mounted in the other end of the housing, and a writing unit having at least a substantial portion thereof mounted in the housing in side-by-side relation with at least a substantial portion of the lighter unit.

11 Claims, 4 Drawing Figures

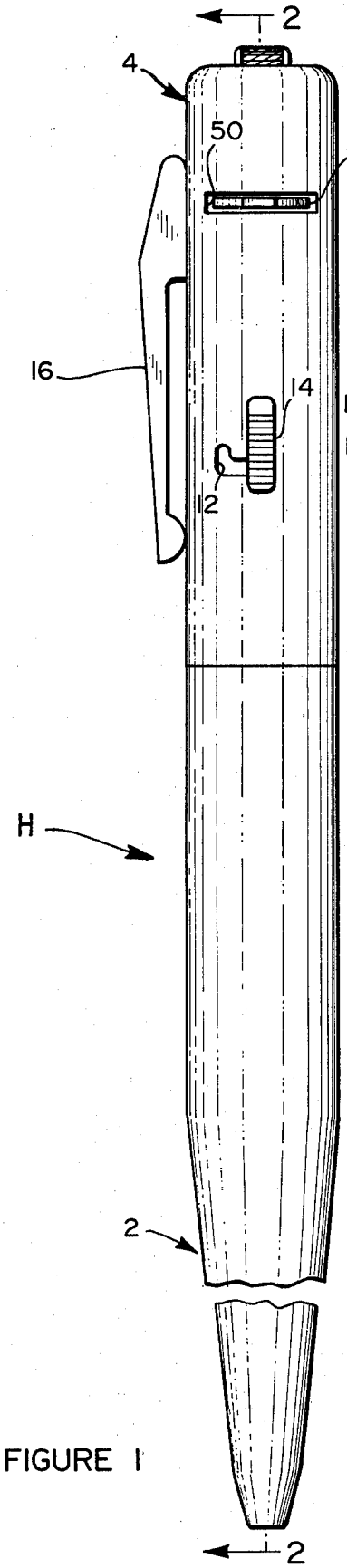
FIGURE 1
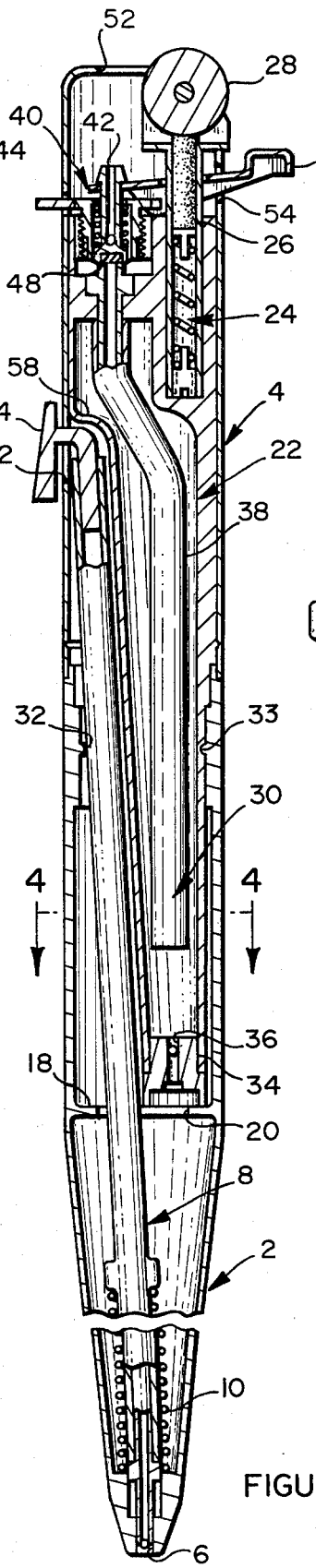
FIGURE 2
FIGURE 3
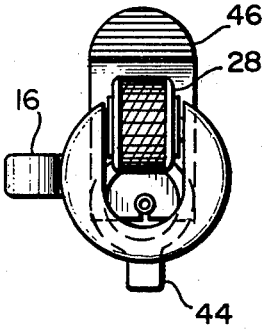
FIGURE 4
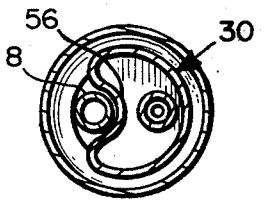

COMBINATION WRITING INSTRUMENT AND LIGHTER

This invention relates to writing instruments having associated in the housing therewith a lighter.

HISTORICAL BACKGROUND OF THE INVENTION

In the past, writing instruments have been devised which provide a lighter element incorporated in the housing. Such devices as Edenburg U.S. Pat. No. 2,308,225, Zapanta U.S. Pat. No. 1,779,110, Mueller U.S. Pat. No. 3,429,644, British Pat. No. 807,295 to Kollisch and Italian Pat. No. 697,887 to Torino are typical of the developments in this field. These patents show the combination but limit the amount of fuel or the amount of writing fluid or both because of the nature of the assembly mechanism. In all instances, the arrangement of the lighter and the pen was back-to-back. Further because of the nature of the back-to-back arrangement, standard insert units for the writing fluid were not available. In most instances, especially designed insert for the writing instrument had to be provided which increases cost considerably.

OBJECTS AND SUMMARY OF THE INVENTION

It is an object of this invention to provide a combination writing instrument and lighter which is compact and inexpensive to manufacture.

A further object of this invention is to provide a writing instrument and lighter combination which provides maximum fuel and fluid ink supply.

Still a further object of this invention is to provide a writing instrument and lighter combination which is easy to assemble and disassemble.

Yet a further object of this invention is to provide a combination writing instrument and lighter which allows for positioning of the separate units without interference with either in the operation thereof.

In general, this invention allows for a side-by-side arrangement of the lighter and writing instrument in order to provide for maximum capacities and ease in replacement of a standard refill for the writing instrument.

These and other objects and advantages of this invention will be apparent from the following description and claims.

In the accompanying drawings which illustrate by way of example various embodiments of this invention:

DETAILED DESCRIPTION OF THE DRAWINGS

FIG. 1 is a top plan view showing this invention;

FIG. 2 is a cross sectional view taken along the line 2—2 of FIG. 1 and viewed in the direction of the arrows;

FIG. 3 is a right end elevational view of the instrument;

FIG. 4 is a cross sectional view taken along the lines 4—4 of FIG. 2 and viewed in the direction of the arrows.

GENERAL DESCRIPTION OF THE INVENTION

As best shown in FIG. 1, the housing H is generally barrel shaped. It comprises a lower member 2 and an upper member 4 which are made from plastic or metal or the like. The members 2 and 4 are held together by a snap fit or other suitable mechanism. The lower member 2 is provided with an opening 6 for receiving a standard ball point ink dispensing unit 8 provided with the standard spring mechanism 10 for maintaining the unit 8 in retracted position as best shown in FIG. 2. The retraction mechanism of the dispensing unit 8 is well-known in the art.

The upper member 4 includes an L-shaped slot 12 in which is positioned a thumb button 14 mounted on the ball point ink dispensing unit 8. A downward push on the thumb button 14 projects the ball point ink dispensing unit 8 from the opening 6. A side manipulation of the thumb button 14 in the base of the L-shaped slot 12, permits the ink dispensing unit 8 to be maintained in extended position because of a slight rearward cut to the slot 12. To retract the ink dispensing unit 8, the lever merely has to be slightly pushed over and sideward so that the spring 10 will act to retract the ink dispensing unit within the housing H.

The upper member 4 is provided with a standard clip 16 for securing the writing implement writing unit in a pocket. It is obvious that the ball point ink dispensing unit might be another type of writing implement such as lead pencil mechanism or the like.

The lower member 2 as best shown in FIG. 2 is provided with an internal shelf or annular ledge 18 which provides an opening 20 through which the ball point ink dispensing unit 8 passes. The shelf 18 acts as a support for one end of the lighter unit 22.

The lighter unit 22 includes a typical spring loaded flint assembly 24 provided with a flint 26 bearing against a standard spark wheel 28 mounted for rotation on the spring loaded flint assembly 24. The lighter unit 22 as shown in the drawings is a butane type although other types using a reservoir could be used including wick types.

The lighter unit 22 includes a fuel reservoir 30 provided with a snap mechanism such a bead or recess 32 which engages a bead or matching recess 33 on the lower member 2. The reservoir 30 has at the bottom thereof a plug 34 with a valve opening 36 to permit the reservoir to be filled.

The lighter unit 22 includes a tubular passageway 38 extending down into the reservoir 30 toward the bottom thereof for dispensing fuel from the reservoir 30 into a standard valve jet burner 40. The jet burner 40 is provided with a spring loaded orifice member 42 which is provided with an adjustment lever 44 so that the height of the flame can be controlled. A thumb lever 46 is provided so that the orifice member 42 may be lifted from the valve seat mechanism 48 to permit the butane gas or the like to travel through the orifice member 42 for ignition by the spark from the rotation of the spark wheel 28 against the flint 26. In general, the details of the ignition mechanism of the lighter unit are well-known in the art and this invention is not directed to those specific details since other types of valves and orifice members including adjustment levers thumb levers and the like for the valve jet burner can be provided.

The upper member 4 is provided with a slot 50 for receiving the adjustment lever 44. The top of the upper member 4 is also provided with an opening as at 52 through which the flame projects when the valve jet burner is ignited. The opening 52 is sufficiently large to permit the spark wheel 28 to project above the upper member 4. An opening in the side of the upper member 4 is also provided at 54 to permit the thumb lever 46 to project outside of the housing H.

It should be noted, that the orifice member 42 of the valve jet burner 40 as well as a spring loaded flint assembly 24 are offset from the center axis of the housing H.

In FIG. 4, it will be noted that the reservoir 30 is kidney shaped in cross section for a substantial portion of the way to provide for reception of the ball point ink dispensing unit in the indentation 56. In general, the upper portion of the reservoir 30 is circular in configuration whereas the lower portion is kidney shaped and the indentation 56 gradually tapers downwardly at an angle from the longitudinal axis of the housing H. Thus, the ball point ink dispensing unit 8 is angled or canted from the longitudinal axis of the housing H. Just above the thumb button 14, the reservoir 30 is provided with a shoulder 58 which affords maximum fuel capacity of the reservoir 30.

The unique arrangement of parts and the side-by-side relationship of the ball point ink dispensing unit 8 and a lighter unit 22 provide for maximum capacity of both units.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A combination writing instrument and gas lighter including:

(a) a barrel housing having a longitudinal axis and ends (b) a writing unit mounted in one end of said housing (c) a lighter unit mounted in the other end of said housing, (d) said entire writing unit being positioned to one side of said lighter unit and having at least a substantial portion thereof mounted in said housing in side-by-side relation with at least a substantial portion of said lighter unit (e) said substantial portion of said lighter unit including a removable gas chamber (f) a fuel feed tube extending into said gas chamber to adjacent the bottom thereof, (g) said gas chamber spaced along a substantial portion of said writing unit (h) said housing having a longitudinal axis, (i) said writing unit being angled with respect to said housing's longitudinal axis (j) said fuel feed tube having first, second and third portions, and (k) said first and second portions being axially offset from each other and said third portion angularly positioned with respect to said first and second portions and connecting said first and second portions.

2. A combination writing instrument and lighter as in claim 1 and wherein:

(a) said writing unit is retractable and extendable.

3. A combination writing instrument and lighter as in claim 1 and wherein:

(a) said housing includes a bottom and a top, (b) said lighter unit extends from the top of said housing, and (c) said writing unit extends from the bottom of said housing.

4. A combination writing implement and lighter as in claim 1 and wherein:

(a) said gas chamber is at least partially indented along its said longitudinal axis.

5. A combination writing implement and lighter as in claim 1 and wherein:

(a) said gas chamber is generally tubular in shape, and (b) said gas chamber includes a recess for receiving a portion of said writing unit.

6. A combination writing implement and lighter as in claim 5 and wherein;

(a) said gas chamber is removably snap fitted to said housing.

7. A combination writing instrument and lighter as in claim 6 and wherein:

(a) said gas chamber includes a refill valve in the bottom thereof.

8. A combination writing implement and lighter as in claim 5 and wherein:

(a) said housing includes a first lower member for gripping and enclosing a portion of said gas chamber, and (b) said housing includes a second upper member for enclosing the remaining portion of said gas chamber.

9. A combination writing implement and lighter as in claim 8 and wherein:

(a) said housing's first lower member receives a portion of said writing unit, and (b) said housing's second upper member receives the remaining portion of said writing unit.

10. A combination writing implement and lighter as in claim 9 and wherein:

(a) said lighter unit includes an adjustable flame mechanism and an igniter mechanism, and (b) said flame and igniter mechanisms are mounted in said housing's second upper member.

11. A combination writing implement and lighter as in claim 10 and wherein:

(a) said writing unit includes a thumb operator, and (b) said thumb operator is mounted in said housing's second upper member.

* * * * *